US011199122B2

(12) United States Patent
Kellner et al.

(10) Patent No.: US 11,199,122 B2
(45) Date of Patent: Dec. 14, 2021

(54) HYBRID DRIVEN DOUBLE PUMP

(71) Applicant: NIDEC GPM GmbH, Auengrund OT Merbelsrod (DE)

(72) Inventors: Steffen Kellner, Remda-Teichel (DE); Sandro Schunk, Hildburghausen (DE)

(73) Assignee: NIDEC GPM GmbH, Auengrund OT Merbelsrod (DE)

( * ) Notice: Subject to any disclaimer, the term of this patent is extended or adjusted under 35 U.S.C. 154(b) by 0 days.

(21) Appl. No.: 16/971,334

(22) PCT Filed: Apr. 2, 2019

(86) PCT No.: PCT/EP2019/058240

§ 371 (c)(1),
(2) Date: Aug. 20, 2020

(87) PCT Pub. No.: WO2019/192984

PCT Pub. Date: Oct. 10, 2019

(65) Prior Publication Data

US 2020/0392890 A1 Dec. 17, 2020

(30) Foreign Application Priority Data

Apr. 3, 2018 (DE) ..... 102018107776.9

(51) Int. Cl.
*F01P 5/10* (2006.01)
*F04D 15/00* (2006.01)
(Continued)

(52) U.S. Cl.
CPC ..... *F01P 5/10* (2013.01); *F01P 7/164* (2013.01); *F04D 1/006* (2013.01); *F04D 13/14* (2013.01);
(Continued)

(58) Field of Classification Search
CPC ..... F01P 5/10; F01P 7/164; F01P 2005/105; F01P 2005/125; F01P 2007/146;
(Continued)

(56) References Cited

U.S. PATENT DOCUMENTS

2003/0094147 A1* 5/2003 Hoelle ..... B60H 1/08 123/41.44
2015/0037177 A1* 2/2015 Buchholz ..... F01P 5/12 417/319

FOREIGN PATENT DOCUMENTS

CN 102498287 A 6/2012
CN 106536888 A 3/2017
(Continued)

OTHER PUBLICATIONS

First Office Action dated Mar. 8, 2021 in related Chinese Application No. 201980014738.4 filed Aug. 21, 2020 (7 pages) with English translation (3 pages).
(Continued)

*Primary Examiner* — Jacob M Amick
(74) *Attorney, Agent, or Firm* — Daniel F. Nesbitt; Hasse & Nesbitt LLC

(57) ABSTRACT

A hybrid-driven dual pump for conveying a coolant for a combustion engine, is proposed. The dual pump comprises: a first pump assembly with a first pump impeller, a first spiral housing and a first pump shaft driven via a mechanical drive connection by a combustion engine; a second pump assembly with a second pump impeller, a second spiral housing, a second pump shaft and an electric drive; a joint pump housing enclosing the first pump assembly and the second pump assembly with a joint pump inlet and a joint pump outlet; and a flap arranged freely pivotably between an outlet of the first spiral housing and an outlet of the second
(Continued)

spiral housing such that a direct flow connection between the first spiral housing and the second spiral housing is blocked.

15 Claims, 3 Drawing Sheets

(51) Int. Cl.

| | |
|---|---|
| ***F04D 13/14*** | (2006.01) |
| ***F01P 7/16*** | (2006.01) |
| ***F04D 1/00*** | (2006.01) |
| *F01P 5/12* | (2006.01) |
| *F01P 7/14* | (2006.01) |

(52) U.S. Cl.
CPC ... *F01P 2005/105* (2013.01); *F01P 2005/125* (2013.01); *F01P 2007/146* (2013.01); *F04D 15/0038* (2013.01); *F05D 2270/64* (2013.01)

(58) Field of Classification Search
CPC .. F05D 2270/64; F04D 15/0038; F04D 1/006; F04D 13/12; F04D 13/14
See application file for complete search history.

(56) References Cited

FOREIGN PATENT DOCUMENTS

| | | | | | |
|---|---|---|---|---|---|
| CN | 106536939 | A | | 3/2017 | |
| DE | 1453709 | A1 | | 2/1970 | |
| DE | 1949432 | A1 | | 4/1970 | |
| DE | 2237108 | B1 | | 2/1973 | |
| DE | 102011001090 | A1 | | 9/2012 | |
| DE | 102012214503 | A1 | | 2/2014 | |
| DE | 102017118264 | A1 | | 2/2019 | |
| GB | 1059768 | A | * | 2/1967 | ..... F04D 13/14 |
| GB | 1059768 | A | | 2/1967 | |
| GB | 1435159 | A | * | 5/1976 | ..... F04D 13/14 |
| GB | 1435159 | A | | 5/1976 | |
| WO | 2015187079 | A1 | | 12/2015 | |

OTHER PUBLICATIONS

First Office Action dated Mar. 8, 2019 in related German Application No. 102018107776.9 filed Apr. 3, 2018 (5 pages) with Google Machine translation (1 page).
International Search Report and Written Opinion dated Jul. 11, 2019 for corresponding International Application No. PCT/EP2018/068981 filed Apr. 2, 2019 (6 pages) with WIPO machine translation (6 pages).

* cited by examiner

HYBRID DRIVEN DOUBLE PUMP

BACKGROUND OF THE INVENTION

The invention relates to a hybrid-driven dual pump for conveying a coolant for a combustion engine.

Numerous electrically driven auxiliary units for a combustion engine are known in the art. Electric drive in pumps makes more flexible control and reaction options possible in relation to operating parameters of a combustion engine, and in particular a conveying power is operable independently of an engine speed and for example as a function of a load of the combustion engine. As a result, in the partial-load range of the combustion engine, as well as in particular travel states of a vehicle, power savings can be achieved in auxiliary units, improving fuel efficiency and reducing the emissions of a vehicle.

However, electrification of auxiliary unit drives also involves compromises so as to take account of a failure scenario in the drive, which is separate from the combustion engine, or to ensure sufficient power reserves when there is a maximum requirement on the cooling power. Thus, failure of the electric motor of a coolant pump or of the power supply thereof necessarily leads to a subsequent forced stop of the combustion engine so as to prevent resulting thermal damage throughout the system. Furthermore, the electric drive has to be configured for a nominal power which reliably covers peak loads of the cooling system, which only occur rarely over the total duration of normal operation or are only attained in the event of particular loads on the combustion engine and exceptional external conditions.

The size, weight and costs of electric motors increase with the nominal power, and variants which compensate for an acceptable power ratio by way of a compact and lightweight construction are associated with a disproportionate increase in costs. This applies specifically to brushless permanent-magnet motors which meet the quality standards of the automotive sector. Thus, a safety-orientated configuration of the electric drive conflicts in particular with the aspect of a high cost factor in relation to the economic viability of producing large numbers of parts.

Hybrid pumps, which counteract the problems of purely electrically or purely mechanically driven pumps, are also known in the art. As a result of the combination of an electric motor and a conventional belt drive to form an output shaft of the combustion engine, the failure safety is improved, while the electric drive can be configured for an average load. Furthermore, circulation of the coolant can be continued during stoppage of the combustion engine, for example, in particular in vehicle having an automatic start-stop system.

However, these constructions of hybrid pumps often suffer from the drawback that in the off state the electric motor has to be entrained by the mechanical drive. During entrainment of a switched-off electric motor, power dissipation occurs so as to overcome cogging torques caused by magnetic fields between the poles of the motor rotor and the stator. Therefore, in a mechanical operating mode of a hybrid drive of this type, the combustion engine has to apply more power than in the case of a purely mechanical drive, reducing the fuel efficiency of the vehicle. Other hybrid pumps are equipped with a clutch, in particular a magnetic clutch, which requires a large installation space and is responsible for a high proportion of the costs of the hybrid pump.

A comparatively compact and favourable construction is disclosed in patent application DE 10 2017 118 264 A1, from the same applicant, which is not yet published as of the application date of the present disclosure. This describes a hybrid drive for a coolant pump, in which a belt pulley and an electric motor are each coupled to the pump shaft of a regulatable pump assembly by means of a separately assigned one-way clutch, which engages in a direction of drive rotation and freewheels in an opposite direction of rotation.

However, at a maximum conveying power, for example in a combined drive mode, hybrid pumps of this type comprising a clutch are limited to a volumetric efficiency based on the dimensioning of the pump impeller or of the pump assembly.

With a view to higher maximum powers, WO 2015/187079 A1 discloses an arrangement of a cooling system in which, in addition to a mechanically driven coolant pump, an electric coolant pump is provided, which is arranged in a bypass line of the mechanically driven coolant pump. A spring-loaded valve flap is arranged at the end of the bypass line, and blocks an output line, from the mechanically driven coolant pump to an opening of an end of the bypass, against a return flow when the electric coolant pump is switched off. The system requires a correspondingly large installation space, and is thus suitable primarily for utility vehicles or similarly large drives comprising a combustion engine.

DE 10 2011 001 090 A1 discloses a comparatively compact cooling system for motor vehicles, in which a mechanically driven, regulatable primary coolant pump and a smaller, electrically driven secondary coolant pump are connected as a combined construction unit. In this context, the electric secondary coolant pump is in turn arranged as a bypass to the primary coolant pump, in such a way that an inlet and an outlet of the electric secondary coolant pump are connected, upstream and downstream respectively from the primary coolant pump, to a primary conveying path of the primary coolant pump. A regulating slide, which is used to prevent a return flow through the bypass when the secondary coolant pump is switched off, is provided in the electric secondary coolant pump. With regard to the pump construction, there is still room for improvements in the integration of efficient, variable-power hybrid pump designs.

DE 10 2012 214 503 A1 discloses a rotation pump having an adjustable conveyance volume, comprising (a) a housing having a first housing structure and a second housing structure, (b) a conveying chamber comprising a first chamber wall formed by the first housing structure, a second chamber wall formed by the second housing structure, an inlet for a fluid in a lower-pressure region and an outlet for the fluid in a high-pressure region, (c) a pump wheel rotatable about an axis of rotation in the conveying chamber, and (d) a contact pressure device for generating a contact pressure, (e) wherein the second housing structure is movable counter to the contact pressure from a first position into a second position relative to the first housing structure, and (f) fluid escapes from the conveying chamber through the gap, circumventing the inlet and outlet, or a circulation of the fluid which reduces the conveying power of the rotation pump occurs in the gap within the conveying chamber.

Accordingly, an object of the invention is to provide a hybrid-driven coolant pump having a compact construction, which makes a high maximum conveying power and a wide, volumetrically efficient conveying power spectrum of the drive powers possible.

BRIEF SUMMARY OF THE INVENTION

The object is achieved by a hybrid-driven double pump for conveying a coolant for a combustion engine having the features of claim 1.

According to the invention, the hybrid-driven double pump is distinguished in that it comprises: a first pump assembly with a first pump impeller, a first spiral housing and a first pump shaft driven via a mechanical drive connection by the combustion engine; a second pump assembly with a second pump impeller, a second spiral housing, a second pump shaft and an electric drive; a joint pump housing enclosing the first pump assembly and the second pump assembly with a joint pump inlet and a joint pump outlet; and a flap arranged freely pivotably between an outlet of the first spiral housing and an outlet of the second spiral housing such that a direct flow connection between the first spiral housing and the second spiral housing is blocked.

The invention thus in the first instance provides a dual pump for a coolant, which has two different drives and comprises a pump housing with a pump inlet and a pump outlet.

By comparison with systems with a mechanical and an electrical coolant pump, the pump construction according to the invention has more compact integration of the two pump assemblies. In this context, depending on the application-specific configuration, both different and equally large dimensioning of the pump assemblies are possible, as well as an asymmetrical or symmetrical pump construction.

As a result of the joint pump inlet and pump outlet, the line system is simplified, since there are no converging lines and installation costs and installation space are saved.

The reduction in installation space and the simplifications in the cooling system make a high conveying power possible, since if required both pump assemblies can be operated simultaneously with maximum drive power, in such a way that, if the jointly used flow cross-sections are selected to be sufficient, this results in a maximum conveying power which is substantially summed together.

It is further made possible to implement a required total conveying power by way of a selective distribution of the partial conveying powers between the two pump assemblies. This likewise makes distribution of the total drive power over each of the partial distribution powers possible. This results in options for control optimisation of the free distribution ratios between an associated volumetric efficiency of the two pump assemblies and an associated efficient rotational speed range of the two drives.

The flap, the position of which is merely influenced by an incoming flow ratio between the two pump assemblies, provides a simple constructional means for automatically preventing a return flow through one of the two pump assemblies if one of the two pump assemblies is temporarily unpressurised or inactive.

Advantageous developments of the hybrid-driven dual pump form the subject matter of the dependent claims.

In one aspect of the invention, the first pump assembly and the second pump assembly may further share a joint pump chamber in which the first pump impeller and the second pump impeller are accommodated.

In this way, a compensatory flow behaviour of a variable conveying power distribution between the pump assemblies is promoted. Furthermore, the construction becomes more compact and contains fewer wall elements, and there is a saving on sealing points.

In one aspect of the invention, the first pump impeller and the second pump impeller are arranged across from one another, facing one another in the pump chamber.

In this way, a more compact construction can be achieved, in particular in the radial measurement, and a suction region, including the shared pump chamber, can be smaller.

In one aspect of the invention, the pump inlet may lead into the pump chamber between the first pump impeller and the second pump impeller.

In this way, a substantially symmetrical flow onto the pump impellers and a uniform inlet guide without further guide elements are possible.

In one aspect of the invention, the first pump assembly may comprise a cylindrical regulating slide which is transferable into an axial overlap with a radial outlet area of the first pump impeller.

In this way, the conveying power of the first pump assembly can be throttled in relation to the provided drive power or rotational speed of the combustion engine.

In one aspect of the invention, the cylindrical regulating slide may be actuated by a hydraulic circuit.

In this way, a reliable actuator system in the wet region of the pump for regulating the first pump assembly can be provided.

In one aspect of the invention, the hydraulic circuit may carry coolant as a hydraulic medium which is diverted from the delivery flow.

In this way, a sealed-off, separate system for guiding an internal hydraulic medium in the wet region of the pump can be avoided.

In one aspect of the invention, the hydraulic circuit may be conveyed by means of an axial piston pump driven reciprocally by the first pump impeller via a cam mechanism.

In this way, a reliable drive of the hydraulic circuit in the wet region of the pump for regulating the first pump assembly can be provided.

In one aspect of the invention, an actuation of the cylindrical regulating slide may be controlled by a proportional valve in the hydraulic circuit.

In this way, a reliable regulation member of the hydraulic circuit for regulating the first pump assembly can be provided.

In one aspect of the invention, a bearing of the second pump shaft and the electric drive are arranged axially overlapping one another.

In this way, a smaller axial measurement of the pump construction can be achieved, in particular in the region of the second pump assembly.

In one aspect of the invention, the hybrid-driven dual pump may further comprise a pump control configured to, based on a received parameter, which is an indicator of a cooling requirement of the combustion engine, and a rotational speed of the combustion engine or of the first pump assembly, calculate control values for a displacement of the regulating slide and for a rotational speed of the second pump assembly, and drive the proportional valve as well as the electric drive as a function of the calculated control values.

In this way, a dedicated control system, optimised for specific operating points of the two pump assemblies, is provided in a central control system of a vehicle for simpler integration.

BRIEF DESCRIPTION OF THE DRAWINGS

Hereinafter, the invention is described by way of an embodiment, referring to the accompanying drawings, in which.

DETAILED DESCRIPTION OF THE INVENTION

Figure 1:
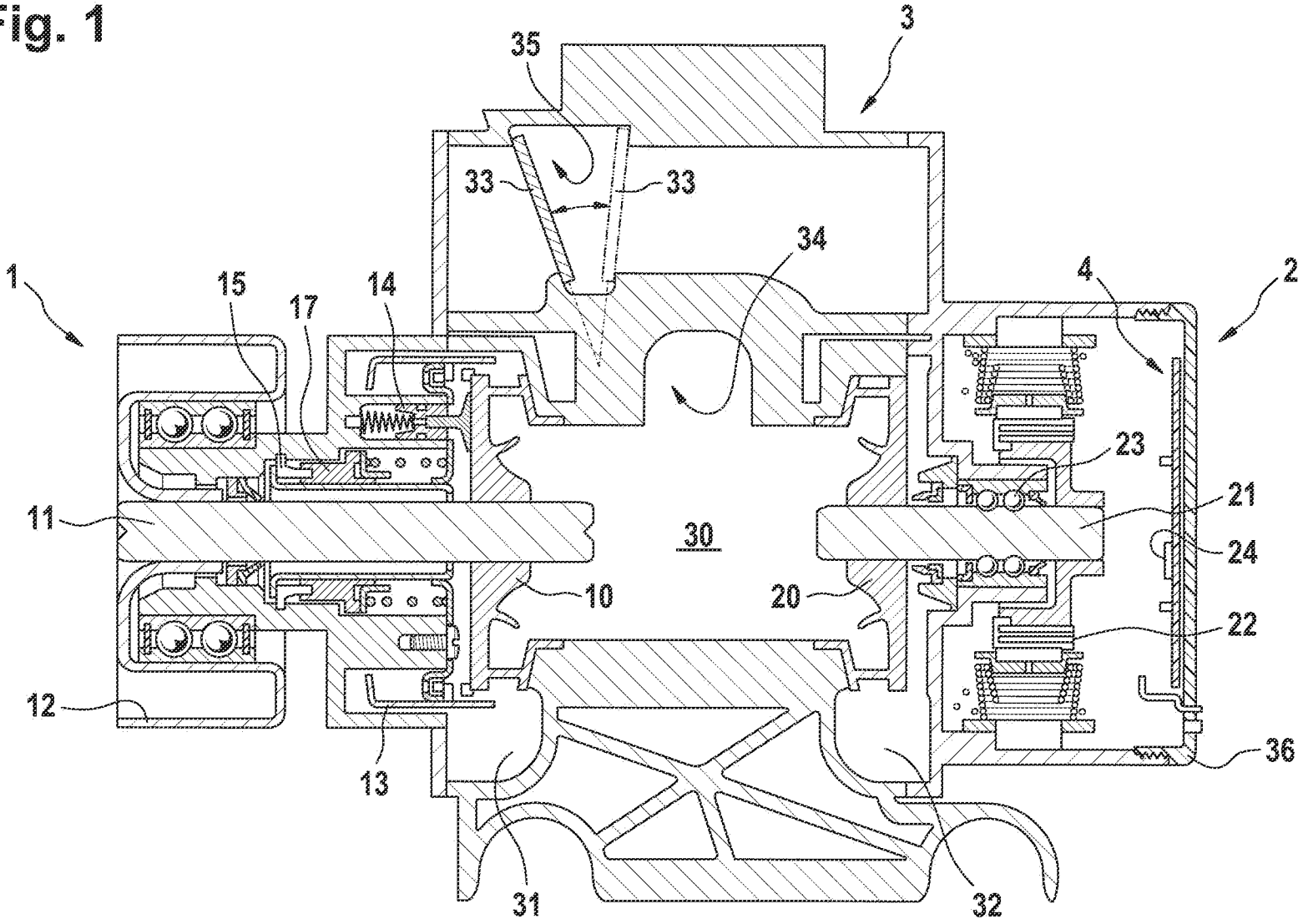
FIG. 1 is a longitudinal sectional view through a hybrid-driven dual pump according to the invention.

FIG. 1 is a sectional view of the entire pump construction, which basically comprises a first pump assembly 1, a second pump assembly 2 and a joint pump housing 3. The pump housing 3 is arranged between the first pump assembly 1 and the second pump assembly 2, and encloses a pump chamber 30. Within the joint pump chamber 30, a first pump impeller 10 of the first pump assembly 1 and a second pump impeller 20 of the second pump assembly 2 are arranged opposite one another.

The first pump impeller 10 is enclosed by a first spiral housing 31 as a portion of the pump housing 3. Likewise, on the opposite side of the pump chamber 30, the second pump impeller 20 is surrounded by a first spiral housing 32 as a portion of the pump housing 3. The first spiral housing 31 and the second spiral housing 32 lead to a joint pump outlet 35, formed as a housing opening. Upstream from the joint pump outlet 35, the first spiral housing 31 and the second spiral housing 32 each have an outlet opening, the cross-sectional planes of said openings extending at an acute angle to one another.

Between the outlet opening of the first spiral housing 31 and the outlet opening of the second spiral housing 32, a flap 33 is arranged pivotably in the pump housing 3. The flap 33 may move in a freely pivotable manner within the acute angle between the cross-sectional plane of the outlet openings as far as a contact position against the outlet opening of the first spiral housing 31 or against the outlet opening of the second spiral housing 32 and block the outlet opening in question. The joint pump outlet 35 in the form of a housing opening is arranged within the pivot region between the contact positions of the flap 33.

The flap 33 is flowed onto by a delivery flow of the first pump assembly 1 and a delivery flow of the second pump assembly 2 from each of the two sides. A position of the flap 33 along the pivot angle thus results from a pressure ratio between the two delivery flows. If the first pump assembly 1 is in operation and the second pump assembly 2 is not in operation, the delivery flow urges the flap 33 into the cross-sectional plane of the outlet opening of the second spiral housing 32 and closes said housing. This provides that the delivery flow from the first pump assembly 1 flows directly through the joint pump outlet 35 and does not arrive in the second spiral housing 32, in other words in an unpressurised output region of the second pump assembly 2. If the second pump assembly 2 is in operation and the first pump assembly 1 is not in operation, the delivery flow urges the flap 33 into the cross-sectional plane of the outlet opening of the first spiral housing 1 and closes said housing. This in turn provides that the delivery flow from the second pump assembly 2 flows directly through the joint pump outlet 35 and does not arrive in the first spiral housing 31, in other words in an unpressurised output region of the first pump assembly 1. If the first pump assembly 1 and the second pump assembly 2 are in operation, the flap 33 takes on an intermediate position along the pivot angle, causing both delivery flows to be guided out of the joint pump outlet 35 while preventing eddies from a direct convergence.

The pump housing 3 further has a joint pump inlet 34. The joint pump inlet 34 is formed as a housing opening to the joint pump chamber 30, and is arranged in an axial region between the first pump impeller 10 and the second pump impeller 20 in the pump housing 3. Depending on the distribution of the pump power between the first pump assembly 1 and the second pump assembly 2, a coolant which flows through the joint point inlet 34 is sucked in a direction towards the first pump impeller 10 or in a direction towards the second pump impeller 20 or in both directions, and accelerated into the spiral housings 31, 32 by means of the radially acting blades of the pump impellers 10, 20.

The first pump assembly 1 is driven via a belt drive by a combustion engine. The belt drive cooperates with a belt drive 12, which drives a first pump shaft 11 on which the first pump impeller 10 is fixed in the pump chamber 30. The first pump assembly 1 corresponds to a mechanically driven, regulatable centrifugal pump.

The embodiment shown in FIG. 1 of the first pump assembly 1 has a hydraulically adjustable regulating slide 13, which is known from an ECF pump type. In this context, a flow-effective radial region around the first pump impeller 10 is variably covered by a cylindrical regulating disc 13, formed coaxial with the first pump shaft 11, along an adjustment path parallel to the first pump shaft 11. In FIG. 1, the regulating slide 13 is in an open position in which the flow region of the first pump impeller 10 is not covered.

The first pump assembly 1 further comprises, within the radius of the first pump impeller 10, an axial piston pump 14, which is driven or reciprocally actuated by the first pump impeller 10 by way of a cam control system, in the form of a sliding show on a wobble plate on a rear face of the first pump impeller 10.

Figure 2:
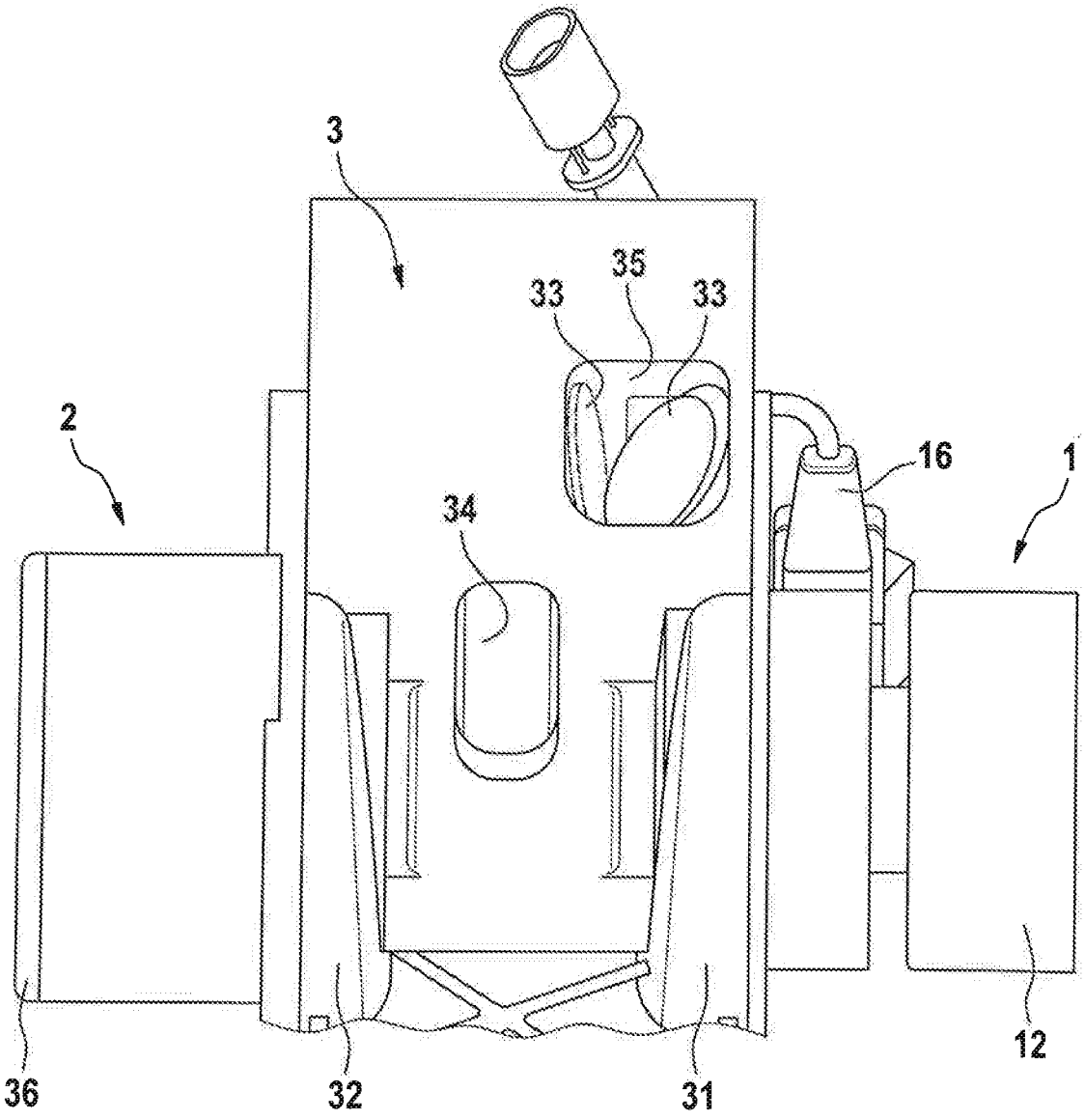
FIG. 2 is a plan view of the hybrid-driven dual pump according to the invention.
Figure 3:
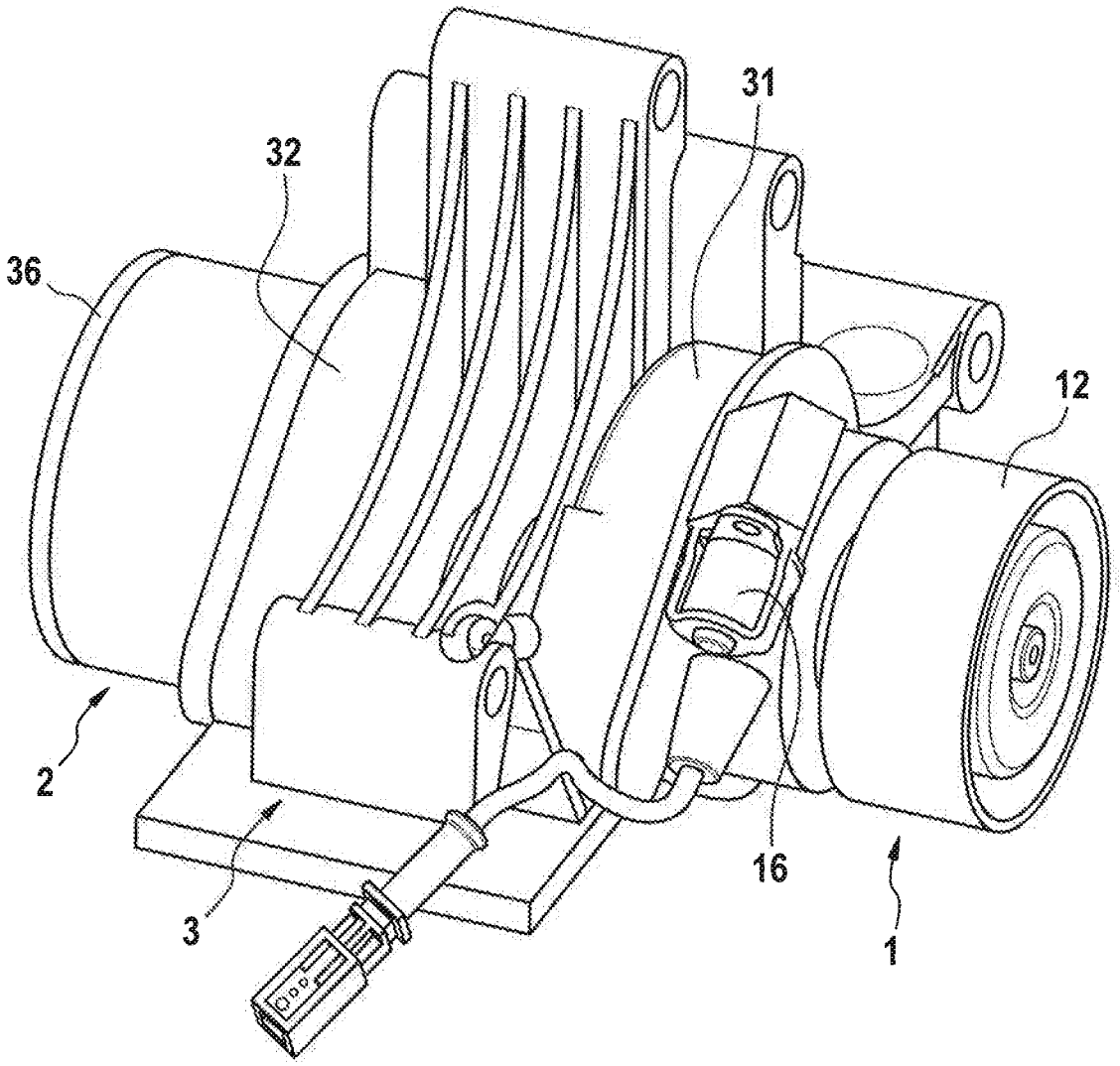
FIG. 3 is a perspective view of the hybrid-driven dual pump according to the invention.

The axial piston pump 14 sucks coolant in between the first pump impeller 10 and the regulating slide 13, and ejects the pressurised coolant into a hydraulic circuit 15 formed in the pump housing 3. The hydraulic circuit 15 comprises an electromagnetic proportional valve 16, shown in FIG. 2 and FIG. 3, and leads to an annular piston 17 arranged coaxial with the first pump shaft 11. The annular piston 17 takes on the function of a hydraulic adjustment member along the displacement path of the regulating slide 13.

A restoring spring (not shown) acts on the annular piston 17 in the opposite direction to the pressure of the hydraulic circuit 15, in other words away from the first pump impeller 10. The annular piston 17 is connected to the regulating slide 13, and slides it in the direction of the first pump impeller 10 as the pressure of the axial piston pump 14 increases in the hydraulic circuit 15.

The electromagnetic proportional valve 16 is opened without a driving current being supplied, in such a way that coolant sucked in by the axial piston pump 14 flows back substantially unpressurised via the hydraulic circuit 15 through the proportional valve 16 into the volume flow of the conveyed coolant. Thus, no pressure builds up in the hydraulic circuit 15, and the annular piston 17 remains in a base position under the action of the restoring spring. In this context, the regulating slide 13 is held in the open position, as is shown in FIG. 1.

In the open position of the regulating slide 13, independently of a pump rotational speed given by the combustion engine via the belt drive, a maximum volume flow, dependent on the rotational speed, of the first pump assembly 1 is conveyed through the regulating slide 13 without shielding of a flow-effective region of the first pump impeller 10. This state also represents a failsafe mode, since in the event of a failure of a power supply, in other words an unpowered electromagnetic proportional valve 16, an unrestricted volume flow and a corresponding heat output at the combustion engine are ensured.

If the electromagnetic proportional valve 16 is closed, the pressure applied by the axial piston pump 14 propagates via the hydraulic circuit 15 and acts on the annular piston 17. The annular piston 17 displaces the regulating slide 13 towards the first pump impeller 10 counter to the force of the restoring spring. In this context, the cylindrical regulating slide 13 is brought into axial overlap with the first pump impeller 10, causing an effective flow region of the first pump impeller 10 to be increasingly covered.

In a closed position of the regulating slide 13, it completely covers the first pump impeller 10, in such a way that, as a result of the shielding, a conveyed volume flow of the first pump assembly 1 is reduced to a minimum or completely suppressed independently of the pump rotational speed.

As is described above, a volume flow conveyed by the coolant pump depends both on the flow effectiveness of the first pump impeller 10, which decreases as the axial displacement of the position of the regulating slide 13 and of the annular piston 17 towards the closed position increases, with an increasing degree of coverage by the regulating slide 13. On the other hand, the conveyed volume flow of the coolant pump depends on the pump rotational speed, which underlies the fluctuations which are characteristic of vehicle operation.

The pressure in the hydraulic circuit 15 is controlled by switch-on and switch-off durations for opening and closing the proportional valve 16 in such a way that an equilibrium between the hydraulic pressure and the pressure of the restoring spring in a position of the annular piston 17 or of the regulating slide 13 is achieved and maintained. The actual position of the annular piston 17 is detected by a travel sensor and used for regulating the proportional valve 16. Throttling of the conveying power of the first pump assembly 1 with respect to the predetermined rotational speed of the combustion engine is carried out by using pulse-width modulation to open and close the electromagnetically actuated proportional valve 16.

The second pump assembly corresponds to an electrically driven centrifugal pump which is regulated in rotational speed.

The second pump assembly comprises an electric motor 22 which is received in the pump housing 3. The electric motor 22 drives the second pump shaft 21, on which the second pump impeller 20 is fixed in the joint pump chamber 30. The electric motor 22 is a brushless DC motor comprising a permanent-magnet rotor, in the periphery of which permanently magnetic elements are embedded. The stator of the electric motor 22 has stator teeth which are distributed over the periphery and which are enclosed by respective windings of a stator coil. The electric motor 22 and the second pump shaft 21 have a joint bearing 23 for rotatable mounting with respect to the pump housing 3.

The stator coils are actuated by a power circuit 24, which is connected to an electric power supply, so as to generate a rotational drive power with a predetermined rotational speed of the electric motor 22. The conveying power of the second pump assembly 2 thus depends on the controllable rotational speed of the electric motor 22.

The hybrid-driven dual pump has a dedicated pump control system 4, which is arranged together with the power circuitry 24 of the electric motor 22 in a pump cover 36.

The pump control system 4 determines whether a power requirement on a cooling power for the combustion engine, on which a switching process between operating modes of the hybrid drive of the coolant pump may be dependent, is increasing or decreasing, by way of connected sensors for measuring a temperature, such as a coolant temperature and/or an external temperature, a load, such as an outputted torque of the combustion engine, a rotational speed of the combustion engine, and/or further operating parameters of the vehicle, such as a gas pedal position, a fuel volume flow or the like. Alternatively, the pump control system 4 receives commands of a power requirement on the cooling power from a central control unit of the vehicle.

In reaction to received or determined parameters, the pump control system 4 controls switching or a combination between the mechanical operating mode of the first pump assembly 1 and the electrical operating mode of the second pump assembly 2, as well as a conveying power distribution, by actuating the proportional valve 16 and by regulating the power circuit 24 in the electrical power supply of the electric motor 22.

LIST OF REFERENCE NUMERALS

1 First pump assembly
2 Second pump assembly
3 Pump housing
4 Pump control system
10 First pump impeller
11 First pump shaft
12 Belt pulley
13 Regulating slide
14 Axial piston pump
15 Hydraulic circuit
16 Proportional valve
17 Annular piston
20 Second pump impeller
21 Second pump shaft
22 Electric motor
23 Shaft bearing
24 Power circuit
30 Pump chamber
31 First spiral housing
32 Second spiral housing
33 Pivotable flap
34 Pump inlet
35 Pump outlet
36 Pump cover

The invention claimed is:

1. A hybrid-driven dual pump for conveying a flow of coolant for a combustion engine, comprising:

a first pump assembly with a first pump impeller having a radial outlet area, a first spiral housing a first pump shaft driven via a mechanical drive connection by a combustion engine, and a cylindrical regulating slide that is actuated a hydraulic circuit, transferable into an axial overlap with the radial outlet area of the first pump impeller, wherein the actuation of the cylindrical regulating slide is controlled by a proportional valve in the hydraulic circuit;

a second pump assembly with a second pump impeller, a second spiral housing, a second pump shaft and an electric drive;

a joint pump housing enclosing the first pump assembly and the second pump assembly with a joint pump inlet and a joint pump outlet that conveys a flow of coolant to the combustion engine; and a flap arranged freely pivotably between an outlet of the first spiral housing and an outlet of the second spiral housing such that a direct flow connection between the first spiral housing and the second spiral housing is blocked.

2. The hybrid-driven dual pump according to claim 1, wherein the first pump assembly and the second pump assembly further share a joint pump chamber in which the first pump impeller and the second pump impeller are accommodated.

3. The hybrid-driven dual pump according to claim 2, wherein the first pump impeller and the second pump impeller are arranged across from one another, facing one another in the pump chamber.

4. The hybrid-driven dual pump according to claim 2, wherein the pump inlet leads into the pump chamber between the first pump impeller and the second pump impeller.

5. The hybrid-driven dual pump according to claim 1, wherein the hydraulic circuit carries coolant as a hydraulic medium which is diverted from the flow of coolant.

6. The hybrid-driven dual pump according to claim 1, wherein the hydraulic circuit is conveyed by means of an axial piston pump driven reciprocally by the first pump impeller via a cam mechanism.

7. The hybrid-driven dual pump according claim 1, wherein a bearing of the second pump shaft and the electric drive are arranged axially overlapping one another.

8. The hybrid-driven dual pump according to claim 1, further comprising a pump control configured to, based on a received parameter, which is an indicator of a cooling requirement of the combustion engine, and a rotation speed of the combustion engine or of the first pump assembly, calculate control values for a displacement of the regulating slide and for a rotation speed of the second pump assembly, and drive the proportional valve as well as the electric drive as a function of the calculated control values.

9. A hybrid-driven dual pump for conveying a flow of coolant for a combustion engine, comprising:

a first pump assembly with a first pump impeller having a radial outlet area, a first spiral housing, a first pump shaft driven via a mechanical drive connection by a combustion engine, and a cylindrical regulating slide that is actuated by a hydraulic circuit and transferable into an axial overlap with the radial outlet area of the first pump impeller;

a second pump assembly with a second pump impeller, a second spiral housing, a second pump shaft and an electric drive;

a joint pump housing enclosing the first pump assembly and the second pump assembly with a joint pump inlet and a joint pump outlet that conveys a delivery flow of coolant to the combustion engine; and a flap arranged freely pivotably between an outlet of the first spiral housing and an outlet of the second spiral housing such that a direct flow connection between the first spiral housing and the second spiral housing is blocked;

wherein the hydraulic circuit is conveyed by means of an axial piston pump driven reciprocally by the first pump impeller via a cam mechanism.

10. The hybrid-driven dual pump according to claim 9, wherein the first pump assembly and the second pump assembly further share a joint pump chamber in which the first pump impeller and the second pump impeller are accommodated.

11. The hybrid-driven dual pump according to claim 10, wherein the first pump impeller and the second pump impeller are arranged across from one another, facing one another in the pump chamber.

12. The hybrid-driven dual pump according to claim 10, wherein the pump inlet leads into the pump chamber between the first pump impeller and the second pump impeller.

13. The hybrid-driven dual pump according to claim 9, wherein the hydraulic circuit carries coolant as a hydraulic medium which is diverted from the flow of coolant.

14. The hybrid-driven dual pump according claim 9, wherein a bearing of the second pump shaft and the electric drive are arranged axially overlapping one another.

15. The hybrid-driven dual pump according to claim 9, further comprising a pump control configured to, based on a received parameter, which is an indicator of a cooling requirement of the combustion engine, and a rotation speed of the combustion engine or of the first pump assembly, calculate control values for a displacement of the regulating slide and for a rotation speed of the second pump assembly, and drive the proportional valve as well as the electric drive as a function of the calculated control values.

* * * * *